US009359653B2

(12) United States Patent
Garrison, Jr.

(10) Patent No.: US 9,359,653 B2
(45) Date of Patent: Jun. 7, 2016

(54) HIGH TOUGHNESS SECONDARY HARDENING STEEL

(75) Inventor: Warren M. Garrison, Jr., Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 381 days.

(21) Appl. No.: 13/881,344

(22) PCT Filed: Oct. 27, 2011

(86) PCT No.: PCT/US2011/058044

§ 371 (c)(1), (2), (4) Date: Apr. 24, 2013

(87) PCT Pub. No.: WO2012/058404

PCT Pub. Date: May 3, 2012

(65) Prior Publication Data

US 2013/0228253 A1 Sep. 5, 2013

Related U.S. Application Data

(60) Provisional application No. 61/455,983, filed on Oct. 29, 2010.

(51) Int. Cl.

| | |
|---|---|
| ***C21D 1/25*** | (2006.01) |
| ***C22C 38/44*** | (2006.01) |
| ***C21D 6/00*** | (2006.01) |
| ***C22C 38/04*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 33/04*** | (2006.01) |
| ***C22C 38/02*** | (2006.01) |

(52) U.S. Cl.

CPC *C21D 1/25* (2013.01); *C21D 6/002* (2013.01); *C22C 33/04* (2013.01); *C22C 38/02* (2013.01); *C22C 38/04* (2013.01); *C22C 38/44* (2013.01); *C22C 38/46* (2013.01); *C22C 38/48* (2013.01); *C22C 38/50* (2013.01); *C22C 38/52* (2013.01)

(58) Field of Classification Search

CPC ..... C22C 38/44; C21D 1/25

USPC ..... 148/331, 335, 548; 420/83, 108, 109

See application file for complete search history.

(56) References Cited

U.S. PATENT DOCUMENTS

2009/0291014 A1 11/2009 Vartanov

FOREIGN PATENT DOCUMENTS

| | | | | |
|---|---|---|---|---|
| EP | 1469094 A1 * | 10/2004 | ..... | C21D 6/002 |
| EP | 2159296 A1 | 3/2010 | | |
| JP | 08-081740 A | 3/1996 | | |
| JP | 2001-131634 A | 5/2001 | | |

OTHER PUBLICATIONS

W. M. Garrison, Jr., "Influence of Silicon on Strength and Toughness of 5 wt-%Cr Secondary Hardening Steel," Materials Science and Technology, vol. 3, 1987, pp. 256-259.

W. M. Garrison, Jr., "A Comparison of the Effects of Cobalt, Silicon, Nickel and Aluminum on the Tempering Response of a medium Chromiium Secondary Hardening Steel" ISIJ International, vol. 46, 2006, pp. 782-784.

International Search Report and Written Opinion dated Apr. 10, 2012, issued in connection with related PCT/US2011/058044 filed Oct. 27, 2011.

* cited by examiner

*Primary Examiner* — Brian Walck

(74) *Attorney, Agent, or Firm* — Downs Rachlin Martin PLLC

(57) ABSTRACT

A secondary hardening steel alloy substantially lacking Cobalt is disclosed. In spite of the substantial lack of Cobalt, a steel alloy of the present disclosure has a low Stage II crack growth, and a high fracture toughness. Applications of a steel alloy of the present disclosure include structural applications, including aircraft landing gear.

27 Claims, No Drawings

HIGH TOUGHNESS SECONDARY HARDENING STEEL

RELATED APPLICATION DATA

This application claims the benefit of priority of U.S. Provisional Patent Application Ser. No. 61/455,983, filed Oct. 29, 2010, and titled "High Toughness Secondary Hardening Steels", which is incorporated by reference herein in its entirety.

FIELD OF THE INVENTION

The present invention generally relates to the field of metallurgy. In particular, the present invention is directed to high toughness secondary hardening steel.

BACKGROUND

Steel used for aircraft landing gear structural members is typically a martensitic steel that has been austenitized, quenched, and then tempered. Three commercially available grades of steel often used for aircraft landing gear structural members include two low alloys steels, AISI Grade 4340 steel and Grade 300M steel, and one secondary hardening steel, AerMet 100®.

SUMMARY OF THE DISCLOSURE

In one implementation, the present disclosure is directed to a high strength steel alloy, which includes iron in a wt. % from about 85 to about 92; carbon in a wt. % from about 0.2 to about 0.5; chromium in a wt. % from about 4 to about 5.5; molybdenum in a wt. % from about 1 to about 3.5; tungsten in a wt. % from about 0.1 to 3.0; vanadium in a wt. % from about 0.3 to about 0.75; nickel in a wt. % from about 0.5 to about 3.5; 0 wt. % to about 0.05 wt. % Cobalt; and wherein the alloy has a $K_{Ic}$ fracture toughness of at least about 100 MPa√m, a Charpy Impact Energy of about 35 Joules, and a Stage II crack growth rate of less than about 50 nm/second.

In another implementation, the present disclosure is directed to a method of synthesizing a high strength steel alloy without cobalt. The method includes combining carbon, chromium, molybdenum, tungsten, vanadium, and nickel to iron to form a mixture in a reaction vessel; melting the mixture; quenching the alloy to at least facilitate a phase transformation from austenite; refrigerating the alloy to reduce the amount of retained austenite; and tempering the alloy to reduce the amount of retained austenite, wherein substantially no cobalt is added during the method, wherein the alloy has a $K_{Ic}$ fracture toughness of at least about 100 MPa√m, a Charpy Impact Energy of about 35 Joules, and a Stage II crack growth rate of less than about 50 nm/second.

DETAILED DESCRIPTION

In one implementation of a steel alloy of the present disclosure, the composition may be substantially free of cobalt, and contain iron, carbon, nickel, chromium, molybdenum, and vanadium, and combinations thereof, while having a high fracture toughness, a slow Stage II crack propagation rate, and stress corrosion cracking toughness ($K_{ISCC}$) not typically associated with substantially cobalt-free, secondary hardening steel alloys.

Iron may be provided in a steel alloy from any of a variety of sources. Examples of iron sources include, but are not limited to, virgin iron produced from iron ore, recycled iron, recycled steel, other sources of iron known to those skilled in the art, and any combinations thereof. In one example, recycled iron or recycled steel, may be used in combination with any other source of iron.

Iron is present in a steel alloy of the present disclosure. In one example, iron is included in an amount from about 85 weight percent ("wt. %") to about 92 wt. %. In another example, iron is present in a range of about 87 wt. % to about 91 wt. %. In yet another example, iron is present in a range of about 89 wt. % to about 91 wt %. In still another example, iron is present in a range of about 89 wt. % to about 90 wt. %.

Carbon is combined with iron to produce steel. Exemplary methods of combining carbon with iron include, but are not limited to, adding coal, coke, or other carbon source to molten iron. Other methods of combining carbon and iron are well known to those skilled in the art. In one exemplary aspect, carbon may change the physical and chemical properties of iron by remaining in solid solution with iron. In another exemplary aspect, carbon may change the physical and chemical properties of iron by reacting with alloying elements also present in iron.

Carbon is present in a steel alloy of the present disclosure. In one example, carbon is present in an amount of about 0.2 wt. % to about 0.5 wt. %. In another example, carbon is present in an amount of about 0.3 wt. % to about 0.4 wt. %. In yet another example, carbon may be present in an amount of about 0.35 wt. % to about 0.38 wt. %. In still yet another example, carbon may be present in an amount of about 0.38 wt. %.

Nickel is present in a steel alloy of the present disclosure. In one example, nickel is present in an amount of about 2 wt. % to about 4 wt. %. In another example, nickel is present in an amount of about 2.5 wt. % to about 4 wt. %. In yet another example, nickel is present in an amount of about 3 wt. % to about 4 wt. %. In still yet another example, nickel is present in an amount of about 3 wt. %.

Chromium is present in a steel alloy of the present disclosure. In one example, chromium is present in an amount of about 4 wt. % to about 5.5 wt. %. In another example, chromium is present in an amount of about 4.2 wt. % to about 5 wt. %. In yet another example, chromium is present in an amount of about 4.5 wt. % to about 5 wt. %. In still yet another example, chromium is present in an amount of about 4.5 wt. %.

Molybdenum is present in a steel alloy of the present disclosure. In one example, molybdenum is present in an amount of about 1 wt. % to about 3.5 wt. %. In another example, molybdenum is present in an amount of about 1.9 wt. % to about 2.1 wt. %. In still yet another example, molybdenum is present in an amount of about 2 wt. %.

Vanadium is present in a steel alloy of the present disclosure. In one example, vanadium is present in an amount of about 0.4 wt. % to about 0.75 wt. %. In another example, vanadium is present in an amount of about 0.4 wt. % to about 0.5 wt. %. In still yet another example, vanadium is present in an amount of about 0.5 wt. %.

Tungsten is present in a steel alloy of the present disclosure. In one example, tungsten is present in an amount of about 0.1 wt. % to about 3 wt. %. In another example, tungsten is present in an amount of about 0.5 wt. % to about 2.5 wt. %. In still yet another example, tungsten is present in an amount of about 0.5 wt. %.

At least one rare earth element may be present in a steel alloy of the present disclosure. Rare earth elements include, but are not limited to, yttrium, cerium, lanthanum, scandium, and any combinations thereof. In one example, a rare earth element or elements may be added individually to a steel alloy. In one example, one or more rare earth elements are present in an amount up to about 0.1 wt. %. In another example, substantially no rare earth elements are present.

In yet another example, rare earth elements may be added by using a mixture of a plurality of rare earth elements commonly called "Mischmetal." In one example, Mischmetal can have lanthanum present in an amount of about 25 wt. % to about 35 wt. %, cerium present in an amount of about 45 wt. % to about 55 wt. %, praseodymium present in an amount of about 4 wt. % to about 7 wt. % and neodymium present in an amount of about 11 wt. % to about 17 wt. %. In another example, Mischmetal can have lanthanum present in an amount of about 30 wt. % to about 50 wt. %, cerium present in an amount of about 50 wt. % to about 70 wt. %, praseodymium present in an amount to about 0.5 wt. % and neodymium present in an amount to about 0.5 wt. %.

In still another example, rare earth elements can be supplied as an alloy with another alloying element including, but not limited to, nickel. The rare earth-nickel alloy can then be added to a steel alloy. Rare earth elements may be provided to perform various functions in the alloy including, but not limited to, gettering of impurities.

Titanium may also be present in a steel alloy of the present disclosure. In one example, titanium may be present in an amount of up to about 0.25 wt. %. In another example, substantially no titanium is present. Niobium may also be present in a steel alloy of the present disclosure. In one example, niobium is present in an amount up to about 0.50 wt %. In another example, substantially no niobium is present.

In one example method that may be used to prepare a steel alloy of the present disclosure, the method includes melting the various components and/or raw materials used to accomplish the desired composition. Those skilled in the art will recognize from the present disclosure the amounts of components and/or raw materials needed to produce the desired composition having the makeup set forth herein. Melting the components may be accomplished by, for example, vacuum induction melting. Those skilled in the art will appreciate that many other methods of melting the components are possible. These other methods include, but are not limited to, vacuum-arc melting, electric arc furnace melting, and any combination thereof. After melting the components and permitting the components to partially or wholly solidify, the components are re-melted using, for example, vacuum-arc melting. Vacuum-arc melting may remove volatile impurities, byproducts, and gases resulting from the liquification of the components. Regardless of the melting process used, or the number of times the components are melted, gettering additives, as described above, may be added to a molten steel alloy. In another example, small additions of manganese (present in an amount of up to about 0.7 wt. %), titanium or niobium may be added to getter impurities (e.g., with or without rare earth element gettering agents).

After melting components, a steel alloy may be partly or wholly solidified. Solidification includes, but is not limited to, casting, forging, or other techniques well known in the art. After solidification, a steel alloy may be "austenitized." Austenitizing includes heating an alloy to a temperature, for example a temperature between 950° C. and 1300° C., for a period of time to facilitate the transformation of the alloy crystals from an austenite phase.

A steel alloy is quenched from a liquid or from a higher temperature solid to a lower temperature solid. In one exemplary aspect, quenching an alloy can cause the conversion of some austenite to martensite, although quenching is not limited only to this particular purpose or this particular phase transformation. Example quenching methods include, but are not limited to, immersion of a steel alloy into air (or other gas), oil, or water; exposing a steel alloy to a continuous flow of a heat-absorbing fluid; placing a steel alloy in contact with a solid-phase conductive heat sink, such as a copper form; removing the conducted heat from the heat sink using methods well known to those in the art; and any combinations thereof.

A steel alloy, when solidified, may optionally be refrigerated. In one exemplary aspect, refrigeration may further reduce the amount of austenite present. While not completely understood, reducing the amount of retained austenite may improve the strength of the steel. The reduction of the amount of austenite may also improve other physio-chemical properties, as is known to those skilled in the art. Refrigeration methods of quenched steels are well known in the art and may include refrigerants such as chilled air, a chilled fluid, a chilled liquid, dry ice or liquid nitrogen.

A steel alloy may be tempered. Tempering may change the distribution of stresses internal to a solidified alloy, induce formation of alloy precipitates, or produce other physio-chemical changes. In some examples, tempering to induce formation of alloy precipitates is sufficient to classify the steel as a "secondary hardening steel," explained below in more detail. Tempering methods are well known to those skilled in the art, and may include reheating the steel to any of a number of temperatures between about 200° C. to about 800° C.

In some example methods of preparing a steel alloy, a first cycle of quenching, refrigerating, and tempering may be repeated to further reduce the amount of austenite in the steel alloy or produce other physio-chemical changes.

Example One

One example of a steel alloy of the present disclosure was prepared according to the following procedure. Iron, carbon, chromium, molybdenum, tungsten, vanadium and nickel were combined into a 180 kg batch to produce a composition shown below in Table I and identified as Alloy "A". This composition is achieved by adding the appropriate raw materials in appropriate amounts using methods known to those skilled in the art. The elements used to form Alloy A were melted using vacuum induction melting. Mischmetal was added just before pouring the liquid steel prepared by vacuum induction melting. The nominal composition of the Mischmetal used 60 wt. % cerium, 36 wt. % lanthanum, 5 wt. % praseodymium, 0.2 wt. % neodymium, 0.3 wt. % iron, 0.04 wt % silicon, and 0.2 wt. % magnesium. The batch was allowed to solidify and then was re-melted using vacuum-arc re-melting. The solid steel after the vacuum arc re-melting was hot worked into flat bar at an initial working temperature of 1150° C. Specimens were prepared in order to measure the mechanical properties of the steel. Preparation included heat treatment of the specimens. Specimen blanks were cut for tensile specimens, for Charpy impact specimens, for specimens to be used to measure the fracture toughness and for specimens to be used to assess resistance to stress corrosion cracking in salt water at room temperature.

Specimens from this batch were oil-quenched using oil at room temperature about 30° C. and then refrigerated overnight at about −196° C. using liquid nitrogen. Each specimen was tempered for about one hour at about the temperature shown in Table II. The samples were water quenched upon removal from the tempering process using water at about 25° C., and then refrigerated in liquid nitrogen. The process of tempering, quenching, and refrigerating, as described above, was repeated three times to produce "triple tempered" samples.

The composition of Alloy "A" is presented below in Table I, as are prior art alloys. The prior art alloys shown are AISI Steel Grade 4340 (identified as "B"), Grade 300M (identified as "C"), AerMet 100® brand secondary hardening steel (identified as "D"), Ferrium M54® brand steel (identified as "E"), H11® brand steel (identified as "F"), and an alloy described in the scientific literature as "Base+Ni" (identified as "G") (The article describing alloy is entitled "A Comparison of the Effects of Cobalt, Silicon, Nickel, and Aluminum on the Tempering Response of a Medium Chromium Secondary Hardening Steel," ISIJ International, Vol. 46, No. 5 (2006).

TABLE I

| Alloy | C | Cr | Mo | W | V | Ni | Si | Co | Mn |
|---|---|---|---|---|---|---|---|---|---|
| A | 0.38 | 4.5 | 2.0 | 0.5 | 0.5 | 3.0 | 0 | 0 | 0 |
| B | 0.38 | 0.9 | 0.25 | 0 | 0 | 1.8 | 0.3 | 0 | 0.7 |
| C | 0.38 | 0.9 | 0.3 | 0 | 0.08 | 1.8 | 0.3 | 0 | 0.5 |
| D | 0.23 | 3.1 | 1.2 | 0 | 0 | 11.1 | 0 | 13.4 | 0 |
| E | 0.30 | 1.0 | 2.0 | 1.3 | 0.10 | 10.0 | 0 | 7.0 | 0 |
| F | 0.40 | 5.0 | 1.3 | 0 | 0.5 | 0 | 1.0 | 0 | 0.5 |
| G | 0.39 | 4.2 | 2.1 | 0.5 | 0.5 | 4.4 | <0.1 | <0.1 | 0.7 |

The mechanical properties of the four samples of Alloy A were tested using methods well known in the art. Specifically, the yield strength, ultimate tensile strength, Charpy Impact Energy, $K_{Ic}$ fracture toughness were tested. Yield strength and ultimate tensile strength were measured using the industry standard method described by ASTM E8/E8M-09 (3.01 Annual Book of ASTM Standards, Standard Test Methods for Tension Testing of Metallic Materials, at 65-91 (2010)). Charpy Impact Energy was measured using the industry standard method described by ASTM E23-07a (3.01 Annual Book of ASTM Standards, Standard Test Methods for Notched Bar Impact Testing of Metallic Materials, at 179-206 (2010)). Fracture toughness ($K_{Ic}$) was measured using the industry standard method described by ASTM E399-09 (3.01 Annual Book of ASTM Standards, Standard Test Methods for Linear-Elastic Plane-Strain Fracture Toughness $K_{Ic}$ of Metallic Materials, at 516-548 (2010)). Stress corrosion cracking resistance in salt water $K_{ISCC}$, and the resistance to Stage II crack growth were measured by the test commonly known in the art as the "slowly rising K method" of Professor Gangloff, developed at the University of Virginia as explained in "Comprehensive Structural Integrity-Environmentally Assisted Fracture", 2003, pp. 31-101 (Elsevier Ltd, Oxford, United Kingdom). Stage II crack growth may also be measured using a test used by Ritchie that is explained in "Effects of Silicon and Retained Austenite on Stress Corrosion Cracking Resistance in Ultrahigh Strength Steels", Metallurgical Transactions A, Vol. 9A, at 35-40 (1978). The foregoing test method explanations are incorporated by reference herein.

Table II displays Alloys A's measured properties. The results of Alloy A are further categorized based on a tempering temperature applied to a sample. Properties of alloys B to G available in the literature are also presented.

TABLE II

| Alloy (Tempering Condition) | Charpy Impact Energy (J) | $K_{Ic}$ (MPa√m) | Ultimate Tensile Strength (MPA) | Yield Strength (MPA) | Stage II Crack Growth Rate (nm/second) |
|---|---|---|---|---|---|
| A (Triple Tempered at 525° C.) | 25.2 | 109.6 | 1972 | 1510 | N/A |

TABLE II-continued

| Alloy (Tempering Condition) | Charpy Impact Energy (J) | $K_{Ic}$ (MPa√m) | Ultimate Tensile Strength (MPA) | Yield Strength (MPA) | Stage II Crack Growth Rate (nm/second) |
|---|---|---|---|---|---|
| A (Triple Tempered at 550° C.) | 33.2 | 125.8 | 1931 | 1558 | N/A |
| A (Triple Tempered at 575° C.) | 34.2 | 145.1 | 1882 | 1586 | 30 |
| A (Triple Tempered at 575° C. and then Tempered for 10 Hours at 500° C.) | 35.6 | 143.6 | 1875 | 1586 | N/A |
| B | 30 | 84 | 1950 | 1620 | N/A |
| C | 25-30 | 66-77 | 1972-1986 | 1655-1689 | 1000 |
| D | 40.7 | 126.4 | 1965 | 1724 | 100 |
| E | N/A | 120.9 | 2027 | 1724 | N/A |
| F | 20 | 30-50 | 2005 | 1675 | N/A |
| G | 32.3 | N/A | 1930 | N/A | N/A |

Alloy A exhibits a $K_{Ic}$ fracture toughness typically associated with other alloys of steel having different compositions. For example, Alloy A, a secondary hardening steel as explained below, exhibits a $K_{Ic}$ between about 100 MPa√m and about 150 MPa√m. Alloy A also lacks cobalt in any substantial amount. In contrast, Alloys D and E, also both secondary hardening steels, each have a $K_{Ic}$ roughly comparable to that of Alloy A, but do include cobalt in substantial amounts.

Furthermore, Alloy A exhibits a $K_{Ic}$ fracture toughness typically associated with alloys of steel that exhibit different mechanical properties. For example, those skilled in the art will appreciate that $K_{Ic}$ is roughly correlated to Charpy Impact Energy. That is, generally a low Charpy Impact energy correlates to a low $K_{Ic}$ and a high Charpy Impact Energy correlates to a high $K_{Ic}$. However, contrary to this expected result, Alloy A exhibits a Charpy Impact Energy that would not be expected to be correlated to a $K_{Ic}$ as high as about 150 MPa√m. For example, Alloy D exhibits a Charpy Impact Energy nearly 20% higher than that of Alloy A, and yet Alloy A exhibits a comparable, if not higher, $K_{Ic}$.

Alloy F (a/k/a "H-11") is a medium carbon secondary hardening steel. Alloy A is secondary hardening steel. Those skilled in the art will appreciated that the Charpy Impact Energy of Alloy F is on the order of 20 J. The fracture toughness of this alloy, which does not contain cobalt, is on the order of 50 MPa√m, even though it has a strength in the range of the strengths exhibited by Alloy A.

Even further, Alloy A exhibits mechanical properties not known to be attained by the other alloys listed in Table I. For example, the Stage II crack growth rate of Alloy A is about 3% of the rate exhibited by Alloy D, a low alloy steel lacking cobalt, and about 30% of the rate exhibited by Alloy D, a secondary hardening steel that includes cobalt.

As mentioned above, Alloy A may be classified generally as a secondary hardening steel. Secondary hardening steels have, among other physical properties, a high hardness (for example, above 45 Rockwell C) that develops upon tempering in a range of about 450° C. to about 600° C. By tempering the steel in this temperature range, it is believed that chemical element components such as molybdenum, chromium, tungsten, and vanadium react with carbon to form precipitates, often referred to as "alloy carbides." Examples of the alloy precipitates believed to be formed include, but are not limited to, $Cr_2C_3$, $Mo_2C$, $W_2C$, and VC. While not fully understood, it is believed that these precipitates interfere with deformation mechanisms, for example acting as dislocation pinning sites, thereby increasing the strength of the steel.

While the present disclosure qualifies measurements and quantities with the term "about," it is contemplated that additional examples using the same quantitative values also exist within the scope of this disclosure without the qualifier "about." For example, the amount of niobium present in an alloy can be 0.50 wt. %.

Exemplary examples have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A steel alloy, comprising:
iron in a wt. % from about 85 to about 92;
carbon in a wt. % from about 0.2 to about 0.5;
chromium in a wt. % from about 4 to about 5.5;
molybdenum in a wt. % from about 1 to about 3.5;
tungsten in a wt. % from about 0.1 to 3.0;
vanadium in a wt. % from about 0.3 to about 0.75;
nickel in a wt. % from about 0.5 to about 3.5;
0 wt. % to about 0.05 wt. % Cobalt; and
wherein the alloy has a $K_{Ic}$ fracture toughness of at least about 100 MPa√m, a Charpy Impact Energy of about 35 Joules, and a Stage II crack growth rate of less than about 50 nm/second.

2. A steel alloy according to claim 1, wherein the alloy exhibits a yield strength in a range of about 1500 MPa to about 1900 MPa.

3. A steel alloy according to claim 1, wherein the alloy exhibits a $K_{ISCC}$ of at least 12 MPa√m.

4. A steel alloy according to claim 1, wherein nickel is present in an amount of about 2 wt. % to about 3 wt. %.

5. A steel alloy according to claim 1, wherein nickel is present in an amount of about 3 wt. %.

6. A steel alloy according to claim 1, further comprising at least one rare earth element present in an amount between about 0 wt. % to about 0.1 wt. %.

7. A steel alloy according to claim 1, further comprising titanium present in an amount of about 0 wt. % to about 0.25 wt. %.

8. A steel alloy according to claim 1, wherein tungsten is present in an amount of about 0.5 wt. % to about 3.0 wt. %.

9. A steel alloy according to claim 8, wherein tungsten is present in an amount of about 0.5 wt. %.

10. A steel alloy according to claim 8, wherein tungsten is present in an amount of about 2.5 wt. %.

11. A steel alloy according to claim 1, wherein manganese is present in an amount of up to about 0.7 wt. %.

12. A steel alloy according to claim 1, wherein chromium is present in an amount of about 4.5 wt. %.

13. A steel alloy according to claim 1, wherein molybdenum is present in an amount of about 2 wt. %.

14. A steel alloy according to claim 1, wherein vanadium is present in an amount of about 0.5 wt. %.

15. A steel alloy according to claim 1, further comprising niobium present in an amount of about 0 wt. % to about 0.5 wt. %.

16. A method of synthesizing the steel alloy of claim 1 without cobalt, comprising:
combining the carbon, chromium, molybdenum, tungsten, vanadium, and nickel to the iron to form a mixture in a reaction vessel;
melting the mixture;
quenching the alloy to at least facilitate a phase transformation from austenite;
refrigerating the alloy to reduce the amount of retained austenite; and
tempering the alloy to reduce the amount of retained austenite, wherein substantially no cobalt is added during the method, wherein, following the tempering, the alloy has the $K_{Ic}$ fracture toughness of at least about 100 MPa√m, the Charpy Impact Energy of about 35 Joules, and the Stage II crack growth rate of less than about 50 nm/second.

17. A method according to claim 16, wherein said combining includes adding 3 weight percent nickel.

18. A method according to claim 16, wherein said quenching includes quenching the alloy in oil.

19. A method according to claim 16, wherein said tempering includes tempering the alloy at a temperature between about 200° C. and about 800° C.

20. A method according to claim 19, further comprising repeating said tempering at least twice to reduce the amount of retained austenite to below about 5%.

21. A method according to claim 16, wherein said refrigerating includes using dry ice.

22. A method according to claim 16, wherein said refrigerating includes using liquid nitrogen.

23. A method according to claim 16, wherein said melting includes vacuum induction melting.

24. A method according to claim 16, wherein said melting includes using vacuum-arc melting.

25. A method according to claim 16, further comprising re-melting the mixture using vacuum-arc melting.

26. A method according to claim 16, further comprising adding at least one rare earth element.

27. A method according to claim 16, further comprising austenitizing the alloy to facilitate a phase transformation from austenite to a non-austenite phase.

* * * * *